United States Patent [19]

Smith

[11] 4,051,951

[45] Oct. 4, 1977

[54] PACKAGE HAVING MEANS FOR PROVIDING COAXIAL ALIGNMENT IN A STACK THEREOF

[75] Inventor: Ernest L. Smith, Kansas City, Mo.

[73] Assignee: Phillips Petroleum Company, Bartlesville, Okla.

[21] Appl. No.: 588,130

[22] Filed: June 18, 1975

[51] Int. Cl.[2] ..... B65D 21/02; B65D 43/08; B65D 5/68

[52] U.S. Cl. ..... 206/508; 220/352; 220/380; 229/5.5; 229/43

[58] Field of Search ..... 206/508; 220/306, 307, 220/352, 380; 229/43, 1.5 B, 5.5, 5.6, 5.8

[56] References Cited

U.S. PATENT DOCUMENTS

| | | | |
|---|---|---|---|
| 2,104,540 | 1/1938 | Hoffman | 229/43 |
| 2,922,563 | 1/1960 | Aldington | 229/43 |
| 2,972,432 | 2/1961 | Flack | 220/380 |
| 2,985,354 | 5/1961 | Aldington | 229/43 |
| 3,019,933 | 2/1962 | Gould | 215/321 |
| 3,065,875 | 11/1962 | Negoro | 220/306 |
| 3,079,037 | 2/1963 | Schechter | 220/212 |
| 3,112,841 | 12/1963 | Martinelli | 229/43 |
| 3,237,800 | 3/1966 | Edwards | 206/508 |
| 3,244,354 | 4/1966 | Bauer | 220/306 |
| 3,315,865 | 4/1967 | Bracht | 206/508 |
| 3,362,565 | 1/1968 | McCormick | 220/355 |
| 3,498,495 | 3/1970 | Davis | 206/519 |
| 3,516,572 | 6/1970 | Davis | 220/306 |
| 3,583,596 | 6/1971 | Brewer | 220/306 |
| 3,743,133 | 7/1973 | Rathburn | 220/306 |
| 3,831,745 | 8/1974 | Rump | 206/520 |
| D. 222,905 | 1/1972 | Kinney | D9/267 |

FOREIGN PATENT DOCUMENTS

| | | | |
|---|---|---|---|
| 1,200,469 | 7/1970 | United Kingdom | 206/508 |

*Primary Examiner*—George E. Lowrance

[57] ABSTRACT

The package comprises a container having an outwardly and downwardly convexly rolled top rim and an inwardly convexly curved bottom rim; and a closure having an inner wall generally conforming to the contour of the mouth of said container, a rim wall joined to said inner wall by a concavely contoured wall having a configuration which at least generally conforms to at least an outer portion of said curved bottom rim, and a skirt depending from the outer periphery of said rim wall. The closure can be provided with support lugs extending inwardly from said inner wall. The closure skirt can be provided with locking lugs to increase the contact with the bottom of said rolled rim. A stacking shoulder can be formed in the closure skirt. The inner wall can be joined to a diaphragm by means of an inclined camming wall.

14 Claims, 7 Drawing Figures

PACKAGE HAVING MEANS FOR PROVIDING COAXIAL ALIGNMENT IN A STACK THEREOF

This invention relates to a package. In one aspect the invention relates to a stackable package. In a specific aspect, the invention relates to a cylindrical container formed from fibrous material in combination with a thermoformed closure provided with means for receiving and centering the bottom of a superimposed container of like configuration. In another specific aspect the invention relates to a thermoformed closure for a container formed from fibrous material and having a rolled rim, the closure being provided with a plurality of means for gripping the container rim.

In the manufacture of a package employing a container and a closure wherein each is made from a relatively flexible material, difficulties are encountered in maintaining mating dimensions. This is particularly true where the container is formed of fibrous material, e.g. paperboard, and the closure is thermoformed from a sheet of synthetic organic thermoplastic material, e.g. polyethylene or polystyrene. The variations in dimensions make it difficult to consistently achieve a satisfactory seal of the packaging cavity and to provide a package which can be readily opened when desired but which has a high resistance to inadvertent opening. The thermoplastic closure and the thermoplastic coating frequently employed on the outer surface of the container have minimal frictional characteristics, rendering it difficult to maintain stable stacks of such containers.

Accordingly, it is an object of the present invention to provide a new and improved package. Another object of the invention is to provide a package having stable stacking characteristics even with stacking surfaces formed of thermoplastic material having low frictional resistance properties. Another object of the invention is to provide a closure having means for gripping the top rolled rim of a corresponding container. Another object of the invention is to improve the seal of a thermoformed closure to a container formed of fibrous material. Other objects, aspects and advantages of the invention will be apparent from a study of the specification, the drawings and the appended claims to the invention.

Figure 1:
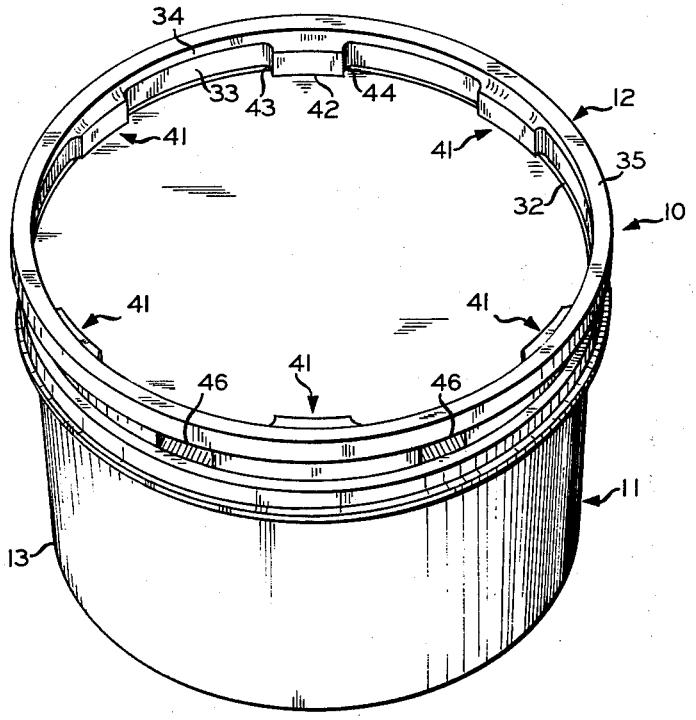
FIG. 1 is a perspective view of a package embodying the present invention.
Figure 2:
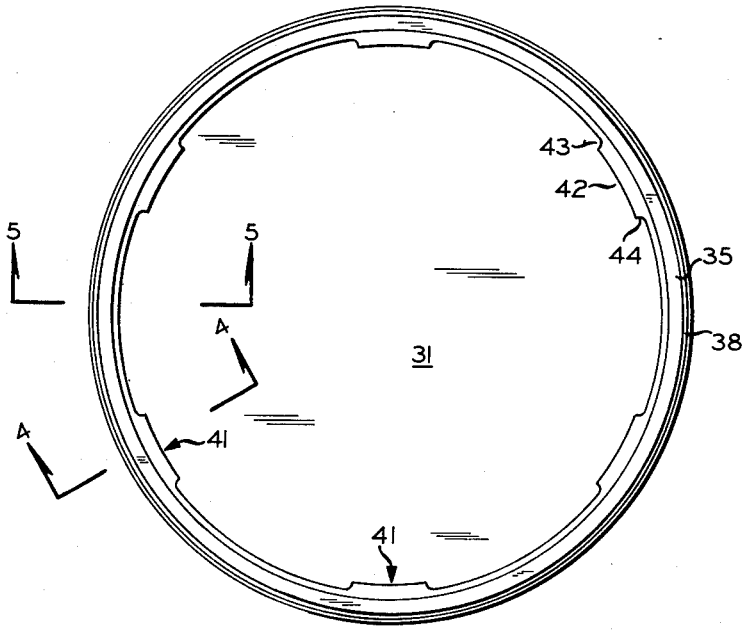
FIG. 2 is a top plan view of the package of FIG. 1.
Figure 3:
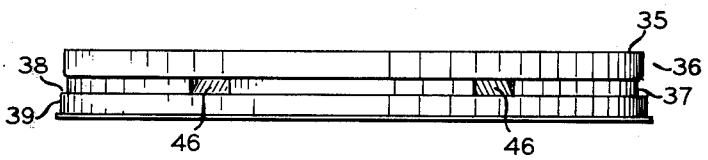
FIG. 3 is a side elevational view of the closure of FIG. 1.

Referring now to the drawings in detail and to FIGS. 1, 4, 5 and 6 in particular, the package 10 comprises a container or cup 11 and a closure 12. The container 11 has a circumferentially continuous sidewall 13 and a bottom member 14, with the bottom member 14 being situated within the space defined by the sidewall 13 and adjacent the lower end of sidewall 13. Apart from the rolled upper rim 15 and the bottom rim 16, the sidewall 13 has a generally cylindrical configuration. The bottom member 14 has a circular diaphragm 17 and an annular skirt 18 depending from the periphery of diaphragm 17. The central portion 19 of diaphragm 17 is depressed below the marginal portion 21. The outer surface of skirt 18 is bonded to the inner surface of sidewall 13 and the annular portion 22 of sidewall 13 which extends downwardly beyond the lower extent of skirt 18 has been curled inwardly and upwardly to form the convexly curved bottom rim 16 which extends inwardly from the cylindrical portion of sidewall 13. The upper margin of sidewall 13 has been curled outwardly and downwardly to form the convexly curved upper rim 15 which extends outwardly from the cylindrical portion of sidewall 13.

Referring now to FIGS. 1-7, the closure 12 is a one-piece structure thermoformed from a synthetic organic thermoplastic material, e.g. polystyrene or polyethylene, has substantially circular horizontal cross sections and comprises a circular closure disc or diaphragm 31 having a diameter only slightly smaller than the diameter of the inner surface of the cylindrical portion of sidewall 13. A generally frustoconical camming wall 32 extends upwardly and outwardly from the outer periphery of diaphragm 31. Annular wall 33 extends at least substantially vertically upwardly from the upper extent of wall 32 in at least general conformity to the contour of the contiguous portion of the sidewall 13 adjacent to and immediately below the commencement of the rolled rim 15. The outer diameter of wall 33 is preferably at least as great as the diameter of the inner surface of the horizontally adjacent portion of the cylindrical portion of sidewall 13 to provide a frictional engagement of wall 33 and the cylindrical portion of sidewall 13. A circumferentially continuous, generally concavely curved annular ring 34 extends outwardly and upwardly from the upper extent of wall 33 to the inner extent of circumferentially continuous annular rim 35 to provide a positioning means for engaging at least an outer portion of the curved bottom rim 16 of a superimposed container 11 which is identical to container 11. The correspondence in the configuration of the upwardly opening concavely curved ring 34 to the downwardly directed convexly contoured outer portion of bottom rim 16 with the diameter of each portion of the vertically extending part of curved ring 34 being only slightly larger than the diameter of the corresponding portion of bottom rim 16 enables the bottom rim 16 of a superimposed container 11′ to enter the space defined by the concavely curved ring 34 and to thereby cause the superimposed container 11′ to be positioned coaxially with closure 12 and container 11. The inner diameter of rim 35 is preferably approximately equal to the maximum outer diameter of the bottom rim 16 with the concave curvature of wall 34 at least substantially conforming to the convex curvature of the outer half of bottom rim 16′. The annular rim 35 extends generally horizontally outwardly from wall 34 to a diameter approximately equal to the maximum outside diameter of rim 15. A circumferentially continuous skirt wall extends generally downwardly from the outer extent of rim 35. The first wall section 36 of the skirt extends generally vertically downwardly from the outer extent of rim 35 for a distance at least equal to the radius of curvature of the outer surface of rim 15 and then extends inwardly and downwardly in general conformity to the curvature of the contiguous portion of rim 15. Skirt wall section 37 extends generally vertically downwardly from the lower periphery of wall section 36, with the inner diameter of wall section 37 being less than the maximum outside diameter of rim 15 and greater than the diameter of the circle midway between the maximum outside diameter of the cylindrical portion of sidewall 13 and the maximum outside diameter of rim 15. In general the curved lower portion of wall section 36 will extend inwardly less than 40% of the horizontal thickness of rim 15, preferably less than 30% of the horizontal thickness of rim 15.

Figure 7:
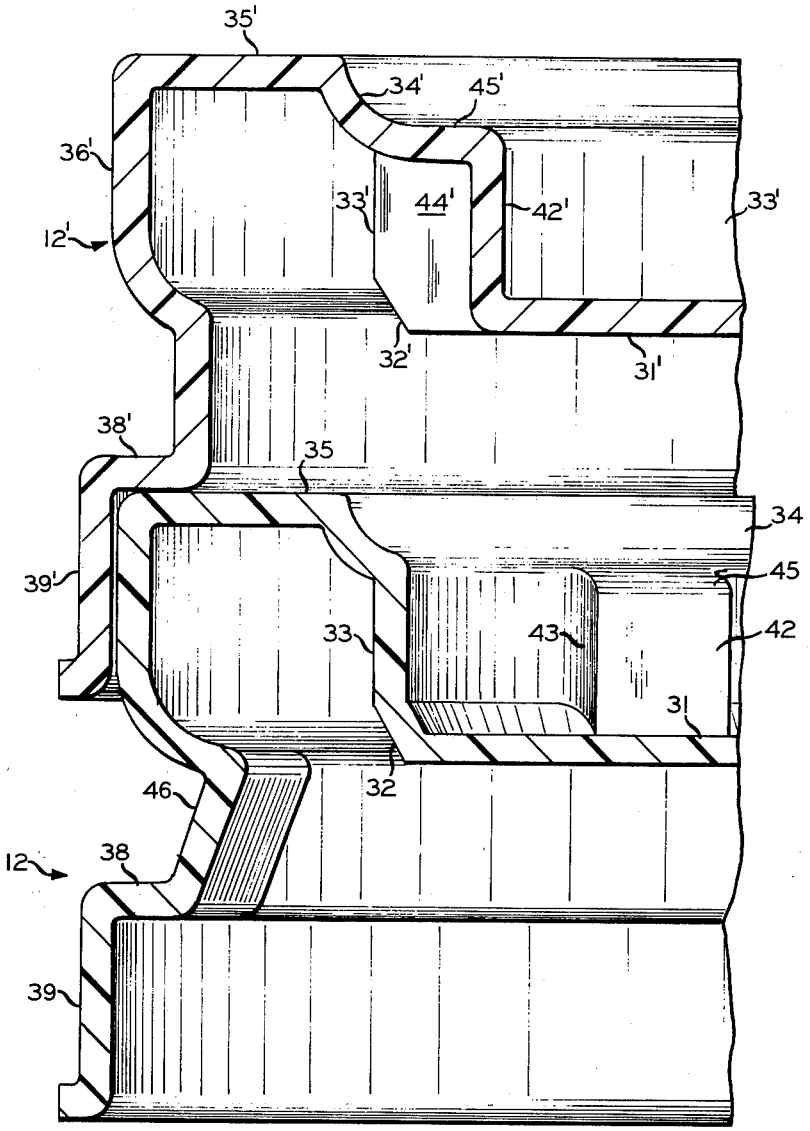
FIG. 7 is a vertical elevational view in cross section through a stack of the closure.

An annular stacking shoulder section 38 extends generally horizontally outwardly from the lower periphery of wall section 37. A skirt wall section 39 extends generally downwardly from the outer periphery of stacking shoulder section 38, with the minimum inner diameter of skirt section 39 being greater than the maximum outer diameter of wall section 36. The inner diameter of stacking shoulder section 38 is substantially smaller than the maximum diameter of rim 35 so that the stacking shoulder section 38' of a superimposed identical closure 12' rests on the rim 35 of the lower closure 12 when the closures are vertically stacked, as shown in FIG. 7. The bottom edge of skirt section 39 can be flared outwardly as shown, extend straight downwardly, or be curled inwardly so long as the minimum inside diameter of skirt section 39 exceeds the maximum outer diameter of wall section 36.

Figure 4:
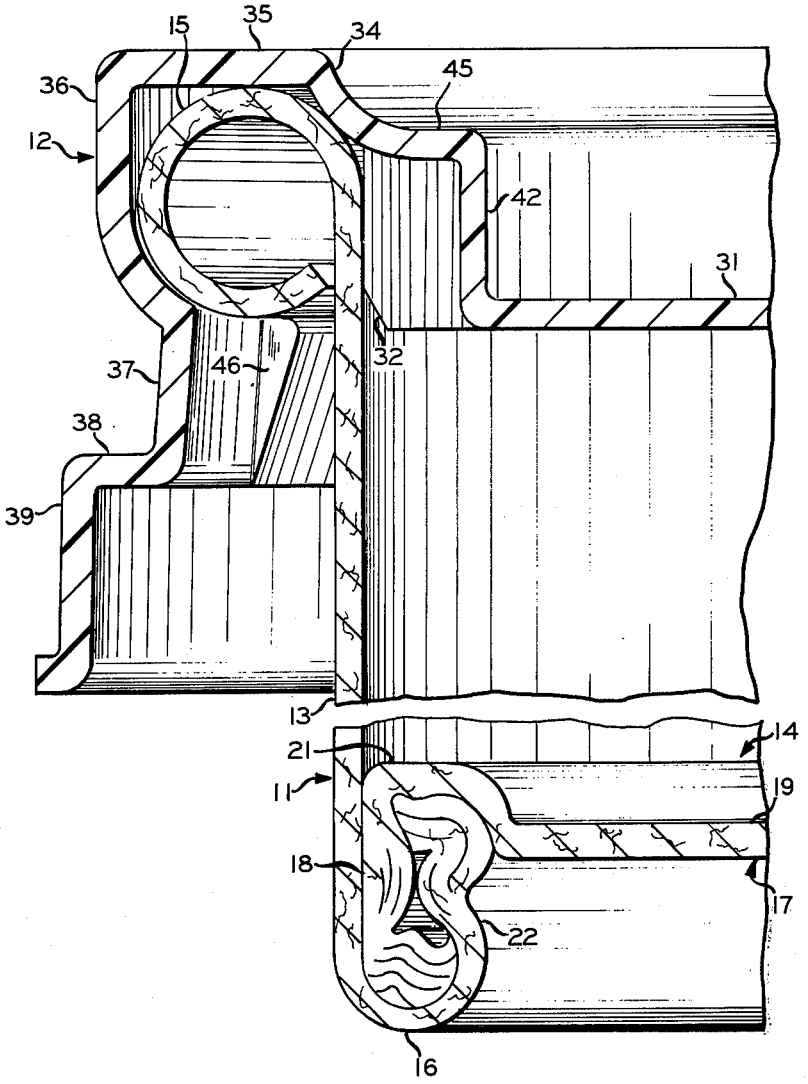
FIG. 4 is a vertical elevational view in cross section taken along line 4—4 of FIG. 2.
Figure 5:
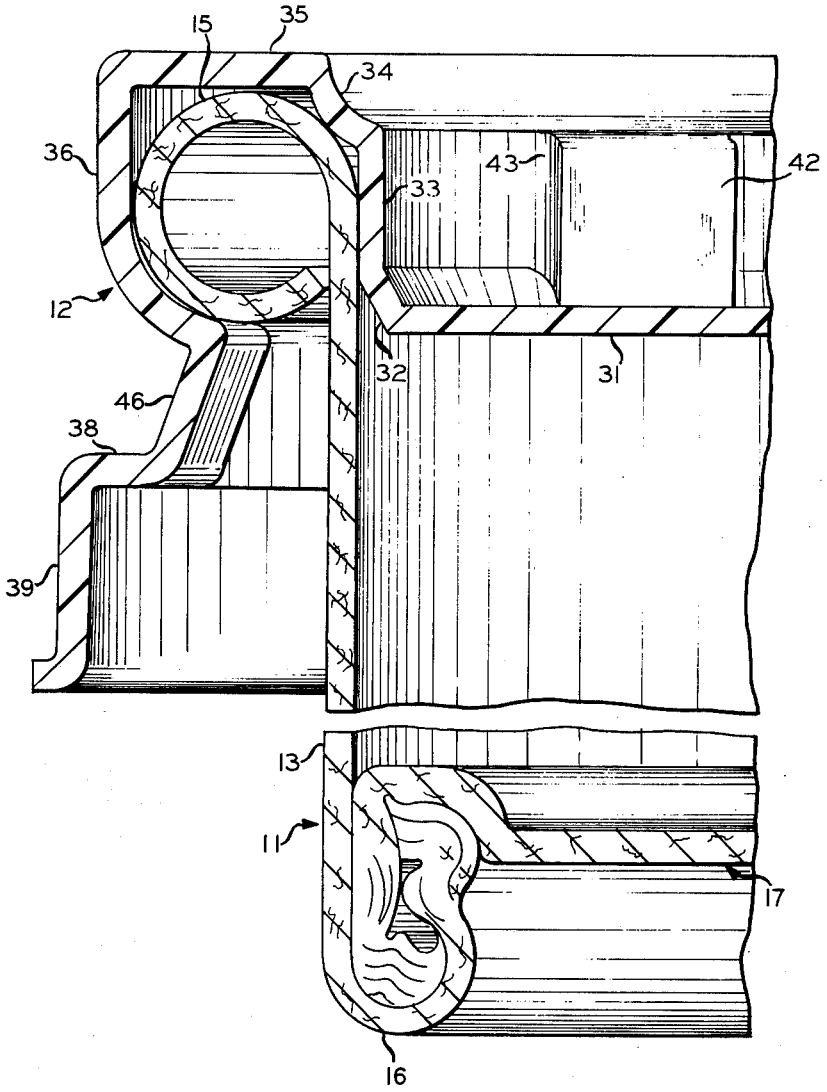
FIG. 5 is a vertical elevational view in cross section taken along line 5—5 of FIG. 2.
Figure 6:
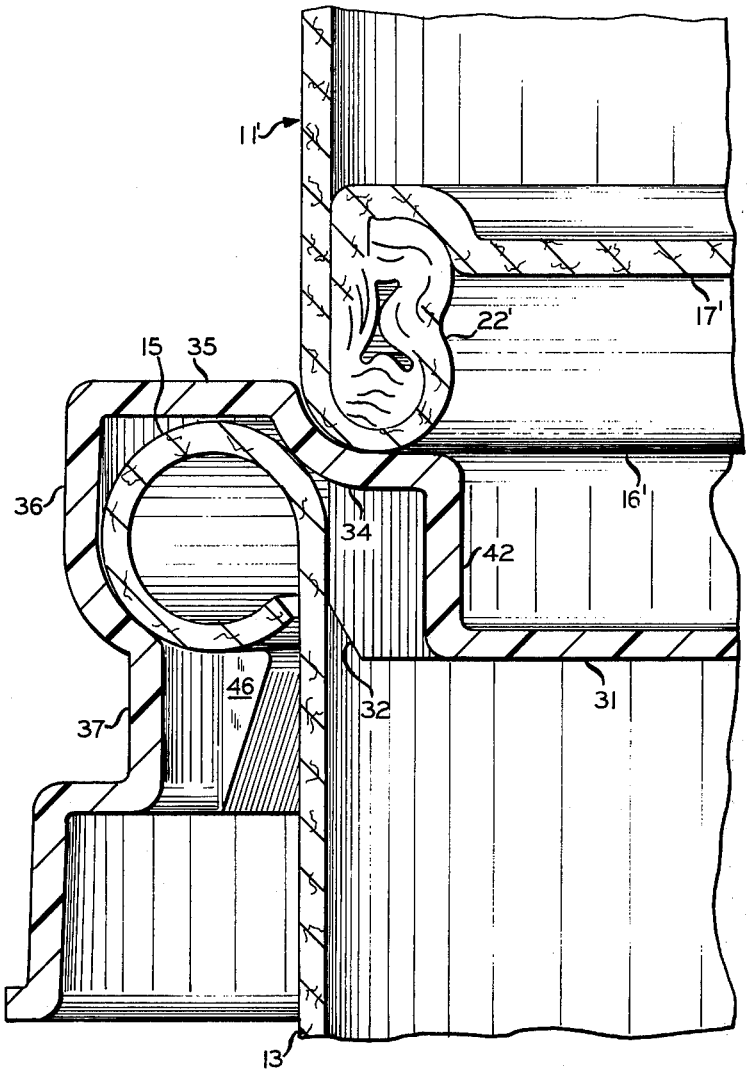
FIG. 6 is a vertical elevational view in cross section through portions of two stacked packages.

In order to increase the support surface for the bottom rim 16' of a properly aligned superimposed container and to prevent the bottom rim 16' of an improperly aligned superimposed container from entering the depression formed by wall 33, the walls 32 and 33 are interrupted by a plurality of support lugs 41 extending inwardly toward the central vertical axis of closure 12. Each lug 41 has an inner wall 42 and sidewalls 43 and 44 which extend generally vertically upwardly from diaphragm 31 to a shoulder 45. Shoulder 45 extends generally horizontally inwardly from the lower extent of curved wall 34 as the upper surface of lug 41. Sidewalls 43 and 44 extend inwardly from wall 33 to the respective inner wall 42. In a presently preferred embodiment there are at least six lugs 41 which are uniformly spaced about the periphery of diaphragm 31. The presence of the lugs 41 also give greater rigidity to the closure structure. In the illustrated embodiment, each of walls 32 and 33 is circumferentially continuous except for the presence of support lugs 41, and support lugs 41 do not interfere with the camming action of wall 32 or the frictional engagement of wall 33 with the corresponding surface of sidewall 13. Annular ring 34 can extend downwardly from rim 35 into sealing contact with the inside upper portion of rolled rim 15 to thereby seal the packaging cavity. Circumferentially continuous seals can also be formed between closure rim 35 and the upper portion of rolled rim 15 and between the lower portion of wall section 36 and the contiguous portion of the lower outside section of rolled rim 15. The illustrated closure structure is particularly advantageous in providing a circumferentially continuous seal between closure 12 and rolled rim 15 regardless of the normally encountered variations in the dimensions of rolled rim 15. Concavely curved ring 34 and the curved lower portion of skirt wall section 36 grip diametrically opposed sections of rolled rim 15 while being capable of being flexed in diverging directions about the line of joinder of rim 35 and the upper portion of wall section 36 during the application of closure 12 to the rolled rim 15 or the removal of closure 12 from engagement with rolled rim 15. The downward and inward inclination of camming wall 32 not only aids in camming the larger wall 33 into the smaller mouth of container 11, but also aids in camming the rolled rim 15 outwardly into the space between wall 33 and skirt wall section 36 as well as providing additional space for the introduction of rolled rim 15 into the grip of annular ring 34 and the curved lower portion of wall section 36. As shown in FIGS. 4 to 6, the gap between wall section 37 and camming wall 32 in a closed package is less than the outside diameter of rolled rim 15. The entire closure skirt can be flexed outwardly to permit the application of the closure 12 to the rolled rim 15, but the degree of flexing required is reduced by the presence of camming wall 32.

In order to enhance the resistance of the closure 12 to accidental removal of the closure 12 from the container 11 to which the closure has been applied, the wall section 37 is interrupted by a plurality of inwardly directed locking lugs or projections 46. The upper end of projection 46 extends inwardly under and in contact with the bead 15.

While the invention has been illustrated in terms of a presently preferred embodiment, other configurations can be employed. The container 11 can have a frustoconical configuration with an angle of taper of several degrees instead of the cylindrical configuration. The horizontal cross sections of the container and the closure can be other than circular, e.g. oval, generally rectangular or polygonal with rounded corners so as to have a circumferentially continuous sidewall 13. Where the seal is provided between rolled rim 15 and annular ring 34, the closure rim 35 and the skirt wall section 36 can be plain or provided with fluting as desired. The bottom member 19 can be recessed within sidewall 13, as shown, or substantially planar with bottom rim 16 or of any other desired configuration which does not interfere with the mating of bottom rim 16' of a superimposed container 11' with the annular ring 34 of the closure 12 on the lower container 11. The configuration of ring 34 can differ from that of curved bottom rim 16' so long as ring 34 can receive and position the bottom rim 16'. The shape, number and uniformity of spacing of lugs 41 and 46 can be varied as desired. While the height of wall 33 and ring 34 can vary with respect to the height of rolled rim 15, it is usually desirable that the combined height of wall 33 and ring 34 be greater than half the height of rolled rim 15, while the combined height of walls 32 and 33 and ring 34 is less than the distance between the bottom surface of shoulder section 38 and the top surface of rim 35. Other reasonable variations and modifications are possible within the scope of the foregoing disclosure, the drawings and the appended claims to the invention.

That which is claimed is:

1. A package comprising a container and a closure therefor;

said container having a circumferentially continuous sidewall and a bottom member, said bottom member being situated within the space defined by said sidewall adjacent the lower end of said sidewall, the upper portion of said sidewall curling outwardly and downwardly to form a rolled top rim, the lower portion of said sidewall curving inwardly to form a generally convexly curved bottom rim;

said closure comprising a first wall, a circumferentially continuous generally concavely curved second wall extending upwardly and outwardly from the upper extent of said first wall, a circumferentially continuous rim wall extending outwardly from the upper extent of said second wall, a circumferentially continuous skirt wall extending generally downwardly from the outer extent of said rim wall, and a diaphragm connected to the lower extent of said first wall; said first wall at least generally conforming to the contour of the portion of said sidewall adjacent to and below the commencement of said rolled top rim; the maximum outside diameter of said first wall before the application of said closure onto its respective container being at least as great as the minimum corresponding dimension of the inside surface of the portion of said sidewall contacted by said first wall upon the application of the closure onto the respective container, thereby providing a frictional engagement of the closure and the respective container; the configuration of said second wall at least generally conforming to at least an outer portion of said curved bottom rim to provide a positioning means for engaging the corresponding portion of the curved bottom rim of an at least substantially identical container superimposed thereabove as said curved bottom rim of said superimposed container enters the space defined by said second wall, thereby causing said superimposed container to be positioned on said second wall coaxially with said closure; said first wall being interrupted by a plurality of spaced apart support lugs which project inwardly from said first wall toward the central vertical axis of said closure, the upper surface of each of said plurality of support lugs extending inwardly from the lower extent of said second wall to serve as additional support surface for the curved bottom of said superimposed container.

2. A package in accordance with claim 1 wherein said second wall extends downwardly from said rim wall into sealing contact with the inside upper portion of said rolled top rim.

3. A package in accordance with claim 1 wherein the portion of said sidewall between said bottom rim and said top rim is at least substantially cylindrical.

4. A package in accordance with claim 3 wherein said diaphragm is connected to the lower extent of said first wall by a camming wall which extends outwardly and upwardly from the outer periphery of said diaphragm to the lower extent of said first wall.

5. A package in accordance with claim 4 wherein said camming wall is generally frustoconical and is circumferentially continuous except for said support lugs.

6. A package in accordance with claim 5 wherein each of said sidewall and said bottom member is formed of fibrous material and said closure is a one-piece thermoformed structure.

7. A package in accordance with claim 1 wherein said diaphragm has a diameter only slightly smaller than the diameter of the inner surface of the horizontally adjacent portion of said sidewall.

8. A package in accordance with claim 1 wherein each of said sidewall and said bottom member is formed of fibrous material and said closure is a one-piece thermoformed structure.

9. A package in accordance with claim 1 wherein said diaphragm is connected to the lower extent of said first wall by a camming wall which extends outwardly and upwardly from the outer periphery of said diaphragm to the lower extent of said first wall.

10. A package in accordance with claim 8 wherein the portion of said sidewall between said bottom rim and said top rim is at least substantially cylindrical.

11. A package in accordance with claim 1 wherein the portion of said sidewall between said bottom rim and said top rim is at least substantially cylindrical; and wherein said skirt wall comprises a first wall section extending downwardly from the outer periphery of said rim wall and then inwardly in general conformity with the outer lower portion of said top rim to thereby engage said top rim.

12. A package in accordance with claim 11 wherein said skirt wall further comprises a second wall section extending generally downwardly from the lower extent of said first wall section, a third wall section extending generally outwardly from the lower extent of said second wall section, and a fourth wall section extending generally downwardly from the outer extent of said third wall section, the minimum diameter of said third wall section being less than the maximum diameter of said rim wall, the minimum inside diameter of said fourth wall section being greater than the maximum diameter of said first wall section so that in a nested stack of a plurality of such closures, the third wall section of one closure rests on the rim wall of the next lower closure.

13. A package in accordance with claim 12 wherein said second wall section is interrupted by a plurality of locking lugs which extend inwardly under and in contact with said top rim.

14. A package in accordance with claim 13 wherein said closure is a one-pieced thermoformed structure.

* * * * *